United States Patent [19]

Onofrio

[11] 4,333,888

[45] Jun. 8, 1982

[54] CARBURETOR ACCELERATOR PUMP STROKE CONTROL

[75] Inventor: David A. Onofrio, Riverview, Mich.

[73] Assignee: Ford Motor Company, Dearborn, Mich.

[21] Appl. No.: 174,072

[22] Filed: Jul. 31, 1980

[51] Int. Cl.[3] ..... F02M 7/08

[52] U.S. Cl. ..... 261/34 B

[58] Field of Search ..... 261/34 B

[56] References Cited

U.S. PATENT DOCUMENTS

| | | | |
|---|---|---|---|
| 3,210,054 | 10/1965 | Gettell | 261/34 A |
| 3,251,585 | 5/1966 | Derengowski et al. | 261/34 B |
| 3,269,711 | 8/1966 | Baldwin | 261/34 B |
| 3,304,067 | 2/1967 | Hebert | 261/34 B |
| 3,764,119 | 10/1973 | Niebrzydoski | 261/34 B |
| 3,886,240 | 5/1975 | Baldin et al. | 261/34 B |

FOREIGN PATENT DOCUMENTS

| | | | |
|---|---|---|---|
| 2021315 | 1/1972 | Fed. Rep. of Germany | 261/34 B |

*Primary Examiner*—Tim R. Miles

*Attorney, Agent, or Firm*—Robert E. McCollum; Clifford L. Sadler

[57] ABSTRACT

A carburetor accelerator pump overtravel lever has an additional stop member connected to it that is engaged at times by a cam rotated by the carburetor choke valve to limit the stroke of the accelerator pump as the temperature increases towards the normal engine operating level.

4 Claims, 4 Drawing Figures

CARBURETOR ACCELERATOR PUMP STROKE CONTROL

This invention relates in general to an accelerator pump for an automotive type carburetor. More particularly, it relates to a control for limiting or decreasing the normal full stroke of the accelerator pump as a function of the movement of the carburetor choke valve.

During cold engine operation, the carburetor choke valve generally is essentially closed to provide the richer air/fuel mixture charge to the engine that is needed to overcome the increased friction, etc. that exists at this particular time, to prevent stalling. When an acceleration occurs, the normal stroke of the accelerator pump is calibrated to provide the desired temporary extra charge of fuel to provide the increase in engine rpm. After the engine begins to warm, however, and the choke valve is opening, it is not necessary or desired to provide the same full shot of fuel from the accelerator pump as when the engine is cold. This not only would decrease fuel economy, but the overrich mixture might cause heavy hesitations on moderate to wide open throttle accelerations.

This invention attempts to eliminate the above disadvantages by providing a control to regulate the stroke or movement of the accelerator pump as a function of choke valve movement to decrease the amount of fuel injected into the engine by the accelerator pump as the temperature increases towards the normal engine operating level. The invention in effect constitutes a temperature compensated accelerator pump to change the pump output as a function of temperature changes.

Devices are known to control the movement of the accelerator pump both as a function of temperature or a manual control, to vary the output of the pump in a desired manner. For example, U.S. Pat. No. 3,210,054, Gettell, CARBURETOR ACCELERATOR PUMP LOCKOUT, shows a construction in which a manually operated stop member 104 (FIG. 6) is moveable into a position to restrict the movement of the conventional accelerator fuel pumping lever. It is to be noted, however, that this is purely a manual operation and not responsive to temperature changes to automatically change the output of the accelerator pump as a function of temperature changes.

U.S. Pat. No. 3,304,067, Hebert, ENGINE CHARGE FORMING DEVICE HAVING A THERMOSTATICALLY CONTROLLED ACCELERATING PUMP, assigned to the assignee of this invention, shows a latching lever 46 that is moveable in response to a predetermined movement of the fast idle cam to lock the accelerator pump overtravel lever 36 (FIG. 8) in a position to prevent the normal full stroke of the accelerator pump. The latching lever is not connected to the choke valve for a related movement.

U.S. Pat. No. 3,251,585, Derengowski et al, and U.S. Pat. No. 3,886,240 Baldin, et al, are further examples of accelerator pump controls to vary the stroke of the pump in accordance with temperature changes.

The invention is directed to an accelerator pump stroke control that varies the stroke as a function of changes in engine operating temperature as indicated by the movement of the choke valve. More specifically, a thermostatically responsive choke valve is connected to a rotatable cam having a contoured face that is adapted to engage at times a stop member or lever connected to the accelerator pump overtravel lever to prevent the pump from attaining a full stroke whenever the choke valve indicates that the temperature is above a predetermined level.

It is, therefore, a primary object of the invention to provide a carburetor accelerator pump stroke control that will vary the stroke of the pump in accordance with the movement of the carburetor choke valve.

Other objects, features, and advantages of the invention will become more apparent upon reference to the succeeding detailed description thereof, and to the drawings illustrating the preferred embodiment thereof; wherein, FIG. 1 is a perspective view of a portion of a carburetor having an accelerator pump mechanism embodying the invention;

Figure 1:
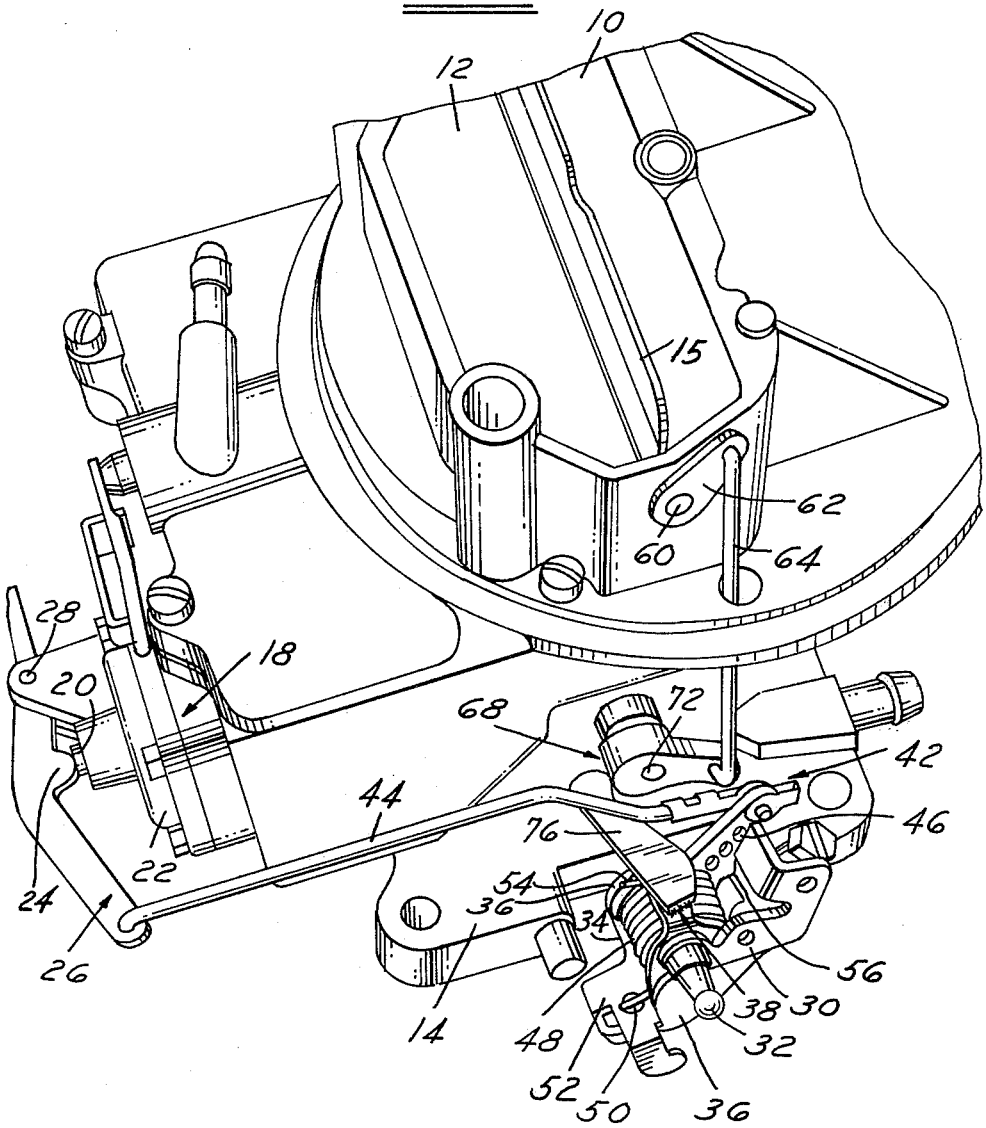

FIG. 1 illustrates schematically a portion of a known type of two barrel carburetor 10 of the downdraft type. It has the usual air/fuel induction passage 12 open at the upper end to air at essentially atmospheric pressure. Its lower flanged end 14 is adapted to be mounted over the intake manifold of an automotive type internal combustion engine, not shown. The induction passage contains a choke valve 15 that is rotatably mounted in the side walls of the carburetor, and a throttle valve, not shown, that is fixedly mounted on a shaft 16 (FIG. 2) for controlling the flow of the air/fuel charge into the engine.

The carburetor also has a conventional mechanically actuated accelerator pump indicated in general at 18. The latter, for example, could be of the flexible diaphragm type to which is attached a plunger 20 that projects slidably outwardly of the pump housing 22 for engagement by a lug 24 provided on a fuel pumping lever 26. Lever 26 is pivotably mounted at 28 on the carburetor body so that pivotal movement in a counterclockwise direction will depress plunger 20 and actuate the pump diaphragm to inject a measured quantity of fuel into the carburetor induction passage 12, in a known manner.

Figure 2:
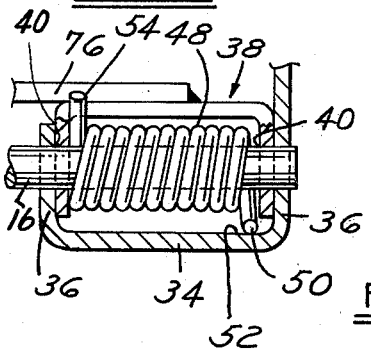
FIG. 2 is a cross-sectional view of a detail of FIG. 1.

The lower portion of the carburetor shown in FIG. 1 shows a linkage mechanism including a throttle valve link 30 that is fixed on throttle valve shaft 16 shown in FIG. 2. Link 30 contains a connector mounting pin 32 that would be connected to the conventional accelerator pedal linkage operated by the vehicle driver. As best seen in FIG. 2, the throttle linkage at its lower end is formed as a yoke 34 having a pair of apertured mounting lugs 36 at opposite ends fixedly secured to the throttle valve shaft 16. Rotatably mounted on shaft 16 between mounting lugs 36 is a second yoke 38 having a pair of apertured bearing portions 40 through which the shaft 16 extends.

Returning to FIG. 1, the carburetor end of yoke 38 is formed with an accelerator pump overtravel lever 42, which, as indicated, is pivotably connected to an actuating link 44 pivotably connected to the accelerator pump fuel pumping lever 26. The overtravel lever 42 has a number of adjusting holes 46 to vary the point of connection of overtravel lever 42 to actuating link 44. The overtravel lever 42 and throttle lever 30 are interconnected by a coil spring 48 that surrounds throttle valve shaft 16 with one end 50 bearing against the lower projecting portion 52 of throttle lever 30 and the other end 54 bearing against the underside of the cross portion of yoke member 38.

Figure 3:
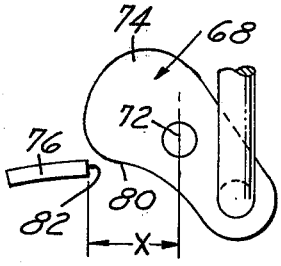
FIGS. 3 and 4 are enlarged schematic representations of details of FIG. 1 illustrating the invention in different operating positions.
Figure 3:
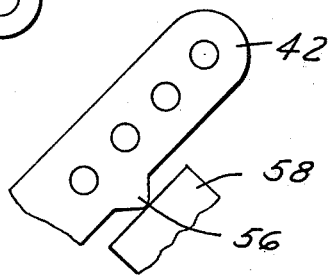

As thus far described, the carburetor and accelerator pump linkage is conventional and operates as follows. When the vehicle operator depresses the vehicle accelerator, it rotates throttle lever 30 clockwise and winds up spring 48 to rotate accelerator pump overtravel lever 42 in the same direction. This moves link 44 to the right, as seen in FIG. 1, to pivot the accelerator pump fuel pumping lever 26 in a clockwise direction to provide a normal full stroke or pumping action of accelerator pump 18. The pump overtravel lever 42 contains an abutment lug 56 that is adapted to engage a portion of the carburetor body 58, as best seen in FIG. 3, for example, to stop or limit the movement of the lever and, therefore, define the stroke of accelerator pump lever 26. The spring 48 permits a further counterclockwise overtravel movement of throttle lever 30.

Figure 4:
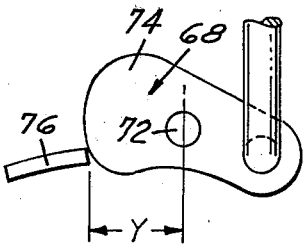
Figure 4:
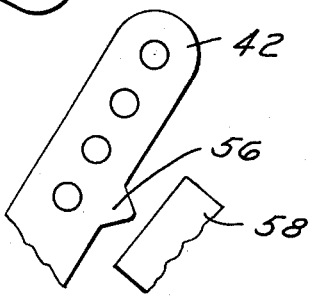

Turning now to the invention, fixed on the choke valve shaft 60 is a lever 62 that is pivotably connected to a link 64. The link in turn is pivotably connected to one end of a bell crank like lever 68 that is essentially kidney shaped as seen in FIGS. 3 and 4, and constitutes a cam. The latter is rotatably and eccentrically mounted on a shaft 72 projecting from the carburetor and has a contoured face 74 that is adapted to cooperate at times with a stop member or lever 76 that is aligned with the cam. The lever 76, as seen in FIG. 1, is welded or otherwise secured to the top side of the yoke 38 of the accelerator pump mechanism and, therefore, moves with the overtravel lever 42.

The choke valve in this case would be connected in a known manner to a thermostatically responsive bi-metallic coil, not shown, so that the choke valve would be urged in a closing direction by the bi-metal spring as the temperature decreases from the normal engine operating level. After the start of the cold engine, therefore, when the choke valve 15 is essentially closed, increases in engine operating temperature will cause a slow opening of the choke valve in a known manner.

FIG. 3 illustrates the position of the stop lever 76 and the cam 68 when the choke valve is in its closed or cold engine operating position. In this case, it will be seen that overtravel lever 42 has been permitted to rotate clockwise its full distance until the stop lug 56 engages the stop 58 on the carburetor. The under side 80 of cam 68 is out of engagement with the edge 82 of the stop lug 76 at this time.

FIGS. 1 and 4 illustrate the positions of the parts when the choke valve is near or in its wide open position. This has caused link 64 to rotate cam 68 counterclockwise to the position shown in FIGS. 1 and 4 whereby the contoured surface 74 has now rotated into the path of stop member 76 during its clockwise movement in response to the movement of throttle lever 30. Accordingly, the overtravel lever 42 is now prevented from moving its full clockwise distance to engage lug 56 with the stop 58. This is reflected in a lesser movement of the connecting link 44 and, therefore, a lesser pivotal movement of the accelerator pump pumping lever 26. Therefore, only a partial stroke of the pump is provided, and less fuel is injected into the engine. It will be seen, of course, that the change from the operations shown in FIGS. 3 and 4 is progressive and, therefore, provides a variable action to the limiting of the accelerating pump stroke control.

From the foregoing, it will be seen that the invention provides a temperature compensated accelerating pump control that limits or decreases the stroke of the pump as a function of the movement of the choke valve. It will also be seen that the invention provides the above control in a simple manner by providing a cam member cooperating with a lever or stop member connected to the accelerator pump linkage in a manner to limit or decrease the stroke of the accelerator pump with temperature increases.

While the invention has been shown and described in its preferred embodiment, it will be clear to those skilled in the arts to which it pertains that many changes and modifications may be made thereto without departing from the scope of the invention.

I claim:

1. A stroke control for the accelerator pump of a carburetor having an induction passage, the flow therethrough being controlled by both a throttle valve and a thermostatically responsive choke valve spaced from one another in the passage and each rotatably mounted for movement across the passage, the accelerator pump having a fuel pumping control linkage operatively connected to the throttle valve for actuation of the pump through a normal full stroke upon a predetermined opening movement of the throttle valve, the stroke control including a cam mounted for movement at times into engagement with a portion of the linkage to restrict the movement of the linkage to provide a less than normal stroke of the pump, and means operatively connecting the cam to the choke valve for effecting a movement of the cam in response to movement of the choke valve, the linkage including a fuel pumping lever movable through a normal stroke to provide a full actuation of the pump, the throttle valve and a throttle lever being secured on a shaft, an accelerator pump overtravel lever rotatably mounted on the shaft and connected to the fuel pumping lever for movement thereof, overtravel spring means surrounding the shaft with opposite ends of the spring interconnecting the overtravel lever and throttle lever permitting relative movement between the two, a stop in the path of movement of the overtravel lever to limit and define the normal stroke of the overtravel lever and the fuel pumping lever, and a further lever secured to the overtravel lever and projecting into alignment with the cam to be engaged thereby at times when the cam is moved a predetermined amount by the choke valve to prevent the overtravel lever from moving into engagement with the stop and thereby decreasing the stroke of the fuel pumping lever.

2. A stroke control as in claim 1, the last mentioned means connecting the cam to the choke valve comprising a link, the cam being eccentrically mounted and having a projection connected to the link to effect rotation of the cam upon rotation of the choke valve, rotation of the cam to one position moving the cam face away from engagement with the further lever, rotation of the cam to another position engaging the cam face and further lever to prevent movement of the overtravel lever into engagement with the stop.

3. A stroke control as in claim 1, the cam having a contour permitting a normal stroke of the pump upon rotation of the choke valve to an essentially closed choke position and reducing the pump stroke upon movement of the choke valve towards an open position in response to temperature increases.

4. A stroke control as in claim 3, the cam comprising an eccentrically mounted member.

* * * * *